United States Patent [19]

DuBois

[11] Patent Number: 4,967,322

[45] Date of Patent: Oct. 30, 1990

[54] REFLECTIVE STICK

[76] Inventor: Arthur E. DuBois, 20 Myrtle Rd., P.O. Box 707, Dennisport, Mass. 02639

[21] Appl. No.: 390,465

[22] Filed: Aug. 4, 1989

Related U.S. Application Data

[63] Continuation-in-part of Ser. No. 280,554, Dec. 6, 1988, abandoned.

[51] Int. Cl.[5] ..... A45B 3/02

[52] U.S. Cl. ..... 362/102; 273/84 R; 135/65

[58] Field of Search ..... 362/102, 110, 111; 446/473, 286, 220; 135/65; 84/477 B; 273/83 R, 84 R; 224/268, 269, 270, 271, 914

[56] References Cited

U.S. PATENT DOCUMENTS

| | | | |
|---|---|---|---|
| D. 275,527 | 9/1984 | Gee | 224/268 |
| 1,130,355 | 3/1915 | Von Eschen | 362/102 |
| 3,113,482 | 11/1960 | Hirsch | 84/477 B |
| 4,099,535 | 7/1978 | Hubachek | 362/102 |
| 4,208,701 | 6/1980 | Schok | 362/102 |
| 4,253,673 | 3/1987 | Bailey | 84/477 B |

*Primary Examiner*—Ira S. Lazarus
*Assistant Examiner*—Sue Hagarman
*Attorney, Agent, or Firm*—Chilton, Alix & Van Kirk

[57] ABSTRACT

A reflective stick comprises a rigid support cylinder having first and second ends, and defining a stick longitudinal axis. A sheet of foil having a reflective outer surface is wrapped around and secured to the support cylinder. Spacers project radially from the cylinder beyond the radial extent of the foil surface. A transparent, tubular sheath coaxially surrounds the support cylinder and has first and second ends extending at least the length of the cylinder, the sheath being maintained in spaced relation from the foil by the spacers. A generally tubular handle is secured in friction-fit, telescopic relation over the first end of the sheath, and a cap is provided for similarly covering the second end of the sheath.

20 Claims, 3 Drawing Sheets

REFLECTIVE STICK

This is a continuation-in-part of application Ser. No. 280,554 filed on Dec. 6, 1988, now abandoned.

BACKGROUND OF THE INVENTION

The present invention relates to reflective safety devices, and more particularly, to hand-held reflective devices that can be used for personal safety while walking at night, or to communicate signals, such as in directing traffic at night A variety of reflective devices and attachments for motor vehicles or the like, are known for use in warning motorists that an individual or automobile is stranded in or walking along the road shoulder. Typically, these devices take the form of a reflective sign mounted on a stand that is set up on the ground behind the vehicle, a reflective tape or sign that is placed on or suspended within the vehicle, or reflective tape wrapped on the clothing, such as the arm of a jacket.

These reflective devices are not suitable for directing traffic, whether by the stranded motorist or by a policeman. Rather, a policeman would use a flashlight or other illuminated light bar or the like, to be waved about in a pattern that communicates to oncoming motorists that they should slow down, or turn right, etc.

SUMMARY OF THE INVENTION

It is an object of the present invention to provide a low cost reflective device that is suitable for a wide range of safety related uses.

It is a more particular object to provide a reflective device that can be used as a warning device on a stranded vehicle, can be held in the hand while walking to ward off passing traffic, can be manipulated to direct oncoming traffic, and can provide a measure of self defense by use as night stick.

In accordance with the invention, a reflective stick comprises a rigid support cylinder having first and second ends, and defining a stick longitudinal axis. A sheet of foil having a reflective outer surface is wrapped around and secured to the support cylinder. Spacers project radially from the cylinder beyond the radial extent of the foil surface. A transparent, tubular sheath coaxially surrounds the support cylinder and has first and second ends extending at least the length of the cylinder, the sheath being maintained in spaced relation from the foil by the spacers. A generally tubular handle is secured in friction-fit, telescopic relation over the first end of the sheath, and a cap is provided for similarly covering the second end of the sheath.

Preferably, the support cylinder is formed as, or contains, a strong, relatively heavy rod member that gives the device the structural characteristics of a police night stick.

In another embodiment of the invention, the transparent, tubular sheath can be eliminated so that the stick comprises a rigid elongated support core member having first and second ends, a sheet member having a reflective outer surface, the sheet being tightly wrapped around and secured to the core member to define a smooth, uncovered reflective surface thereon, and an elongated substantially cylindrical handle extending longitudinally at one end of the core member.

The inventive device can be included in a kit with a rubber suction cup or the like, so that a motorist can "stick" the cup on the fender of a stranded vehicle, and hang the device from the cup. If the motorist decides to abandon the vehicle and walk for help, the device can easily be held in the hand and provide excellent reflective characteristics to ward off oncoming traffic.

The stick-like shape and 360° reflective surface area of the device, permits the invention to be used as a traffic control device by the motorist or a police officer.

Moreover, the inventive device can be used for the primary purpose of night traffic control by police and other municipal authorities. Especially in the preferred embodiment including the relatively heavy, stiff support tube, the stick-like reflective device can serve the dual function of an effective night stick as well as a traffic control device.

BRIEF DESCRIPTION OF THE DRAWINGS

These and other objects and advantages of the invention will become more evident from the following description of the preferred embodiment and accompanying drawings, in which:

FIG. 7 shows a suction cup for hanging the stick from a vehicle fender or the like.

DESCRIPTION OF THE PREFERRED EMBODIMENT

Figure 1:
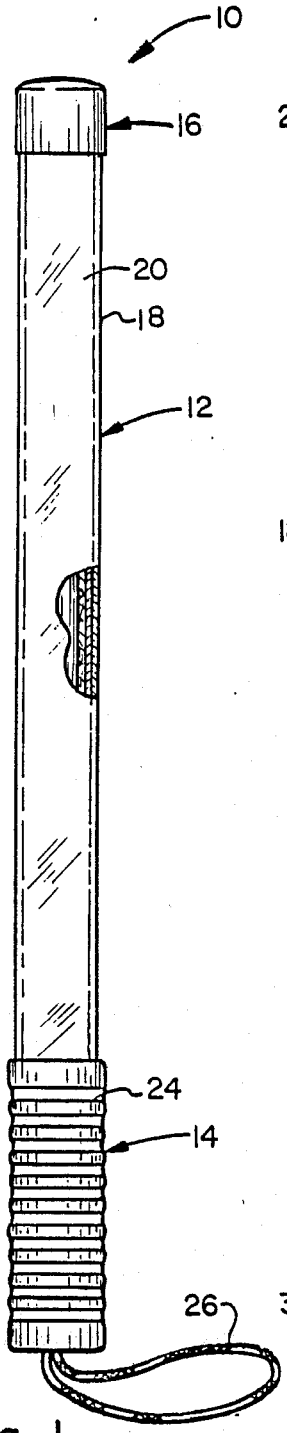
FIG. 1 is an elevation view of the preferred embodiment in the form of a reflective stick.
Figure 2:
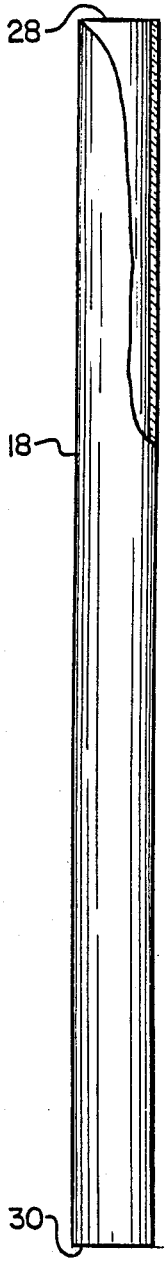
FIG. 2 is an elevation view, partly in section, of the transparent, outer sheath of the stick of FIG. 1.
Figure 3:
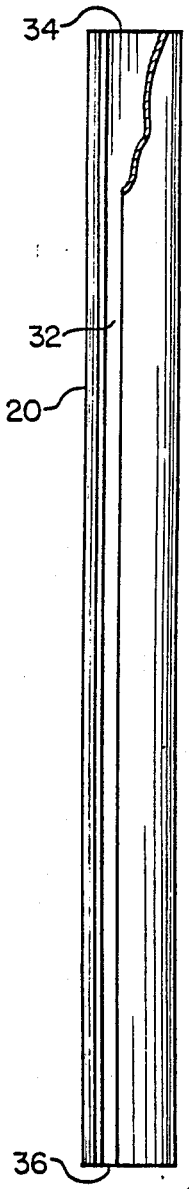
FIG. 3 is an elevation view of the reflective foil before it is wrapped and secured to the support tube in the embodiment of FIG. 1.
Figure 4:
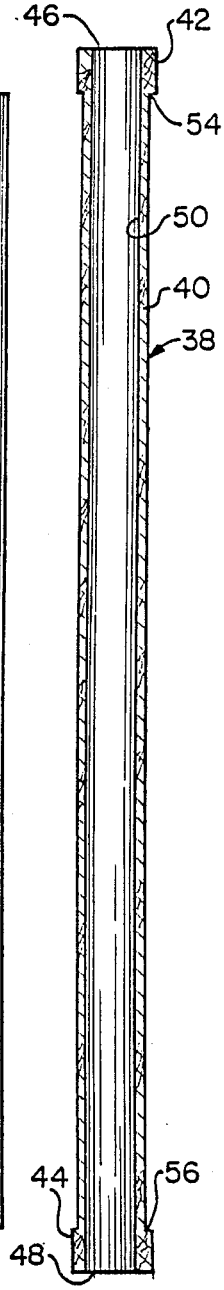
FIG. 4 is an elevation view of the support tube of FIG. 1.
Figure 5:
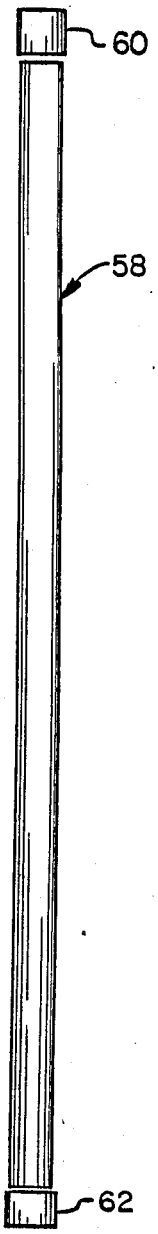
FIG. 5 is an elevation view of the solid, central rod preferably used with the embodiment shown in FIG. 1.

FIG. 1 shows an assembled reflective stick 10, and FIGS. 2–6 show the component parts in accordance with the preferred embodiment. The stick 10 has an elongated, generally cylindrical appearance, and can be made in a variety of lengths and diameters.

Figure 7:
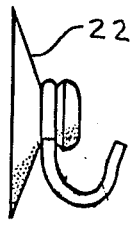
Figure 6:
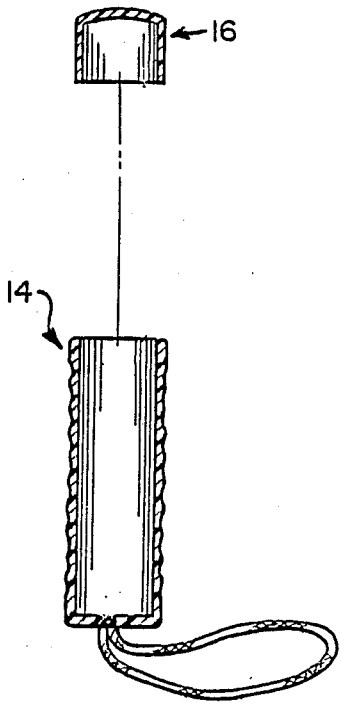
FIG. 6 shows the handle and cap members on the reflective stick of FIG. 1.

The stick 10 has three main, exteriorly visible parts, namely, a handle 14 at the lower end, a middle, reflective section 12, and a cap 16 at the upper end. The middle section reveals a transparent outer sheath 18 containing a foil or similar wrap 20 that reflects light and thus performs the primary function of the device. The stick is grasped in the hand around the handle or grip 14, and can easily be manipulated for traffic control or other communication function. Preferably, the handle is ribbed 24 and the lower end includes a leather strap 26 or the like, for placement around the users's wrist when the device is used manually. Alternatively, the strap can be used to hang the device from a convenient projection, such as a hook on a suction cup 22 attachable to an automobile fender or the like (FIG. 7).

The stick is preferably assembled in component parts, as follows. A rectangular piece of foil 20 having a reflective outer surface, is conveniently bent in the form of a tube or cylinder having a longitudinal slit 32 and upper and lower ends 34, 36. Such foil can be obtained from the Reflexite Company of New Britain, Conn., under the name Reflexite. The foil is wrapped around a support cylinder or tube 38, and is preferably adhesively bonded thereto.

The support tube 38 has an intermediate portion 40 that is substantially cylindrical with a given diameter, and first and second enlarged ends 42, 44, with a larger diameter. The support tube can be formed as a solid member, but preferably is a unitary cardboard or plastic structure having a longitudinal channel 50 about its axis. The enlarged end portions 42, 44 can be integrally formed, or consist of separate parts friction fit in telescoping relation on the ends of the intermediate portion 40.

The longitudinal dimension of the foil between ends 34, 36 is no greater than the longitudinal dimension of the intermediate portion 40 of the support tube which is defined as the distance between shoulders 54, 56. Thus, the circumferential surface of the end portions 42, 44 of the support tube extend radially beyond the radially outer, reflective surface of the foil 20. In general, it is desirable to provide such radial projections relative to the foil surface, to serve as spacers for facilitating the passage of the support tube with attached foil, into the transparent tubular sheath 18 shown in FIG. 2. Without the spacer structure, the foil 20 has a tendency to bind against the sheath inner surface as the sheath and support tube move axially relative to each other during assembly. The foil might thus be torn, and its reflective surface mottled by contact with the sheath.

The sheath 18 is preferably selected to have a length from first to second end 28, 30, that is approximately the desired overall length of the reflective stick including handle. Similarly, the support tube or cylinder 38 preferably has an overall length, including end portions 42, 44, that is substantially equal to the length of the sheath 18. The enlarged end portions 42, 44 have an outer diameter that is substantially equal to the sheath inner diameter, so that some frictional resistance is generated as the support tube is inserted within the compliant plastic sheath, which tends to prevent relative movement therebetween during use.

In one embodiment, the support tube 38 itself, or a rod 58 inserted in the channel 50 of the support tube, is made from a relatively heavy, stiff material, such as metal, wood, or heavy plastic. From the point of view of optimizing low cost production while retaining design flexibility, the support tube 38 is made from light weight plastic or cardboard to provide the minimum rigidity necessary for supporting the foil 20. Optionally, a heavy rod 58 can be inserted within the channel 50 in those embodiments which are to provide the additional safety function of a so called "night stick".

In the night stick embodiment, the rod 58 is inserted into the channel 50, and first and second plug members 60, 62 are bonded or otherwise attached to the first and second ends 46, 48 of the channel to retain the rod therein. After the rod has been secured within the channel, the support tube 38 is inserted into the sheath is in the manner described above.

The final steps in assembling the device include securing the handle or grip 14 to the sheath lower end 30, and the cap 16 to the upper end 28. For cost minimization, the sheath 18 typically is open at both ends 28, 30, so that the handle 14 closes the lower end 30 and the cap 16 closes the upper end 28. The handle 14 and cap 16 can be secured by friction fit engagement with the outer surface of the sheath 18. If the sheath 18 has one closed end, the support tube 38 with foil 20 is inserted from the open end, and only that end need be closed by the cap or handle. The other end would, for aesthetic purposes, usually have a handle or cap secured thereto in any event.

Figure 8:
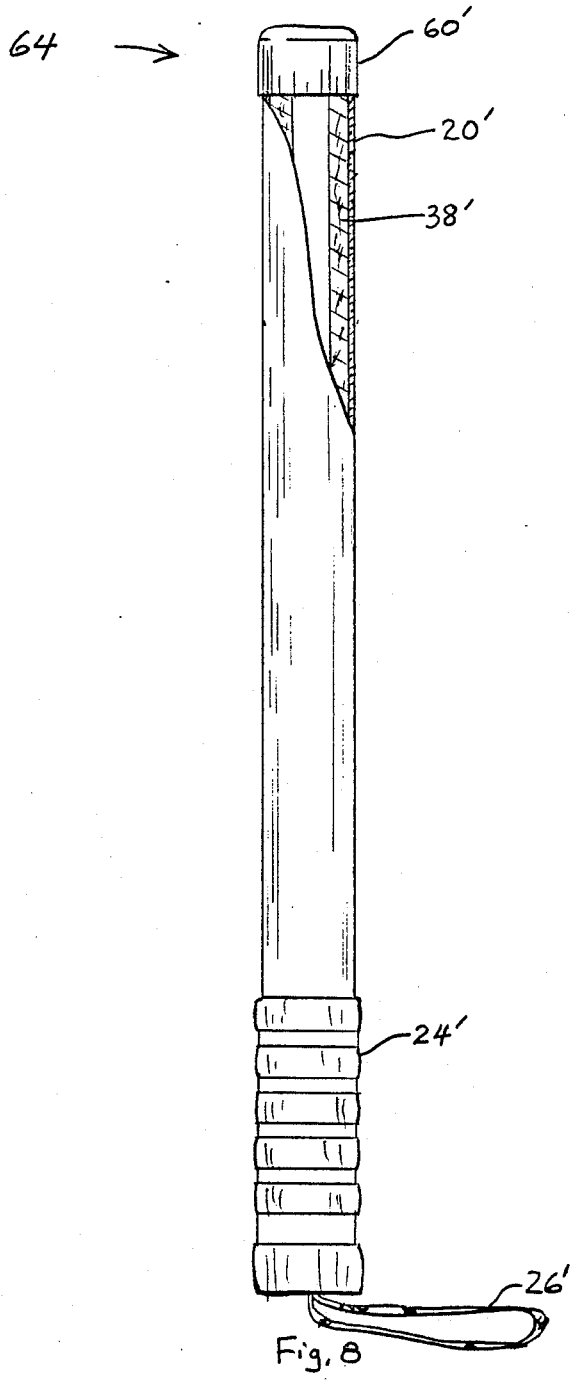
FIG. 8 is an elevation view, partly in section, of an alternative embodiment of the invention, which has no outer sheath.

FIG. 8 shows another embodiment of the invention, in which the reflective night stick 64 is quite similar to the embodiment shown in FIG. 1, in that it comprises a rigid elongated support core member 38' defining a stick longitudinal axis, a reflective sheet member 20' and an elongated, substantially cylindrical handle 24' extending longitudinally at one end of the core member. A leather thong 26' or a similar loop structure extends from the handle 24'.

The significant difference between the embodiment of FIGS. 1 and 8, is that the embodiment of FIG. 8 can be manufactured at lower cost and is suitable for occasional or otherwise undemanding use. With the embodiment of FIG. 1, the clear sheath serves two important functions. First, it enhances the rigidity of the night stick and permits the use of a relatively thinner core for support member 38, so that even if the stick is handled in a rough manner, the appearance, rigidity and reflective properties are not adversely affected. With the embodiment of FIG. 8, a thicker core member 38', and perhaps a solid core rather than the tubular core shown in FIG. 8, would be preferred, to maintain rigidity of the stick, but the reflector material 20' tightly wrapped around and secured to the core member has its reflective surface directly exposed to the user and the environment. Impact or sliding contact between the reflector material 20' and a hard or abrasive surface could mar the appearance and affect the uniformity of reflection of the material, butt this relative disadvantage may not be important under occasional or benign conditions of use.

For example, although any of the illustrated embodiments could be used with the suction cup 22 shown in FIG. 7, if the night stick were needed only for the purpose of warning motorists of the location of a disabled vehicle, by hanging the stick 10 or 64 by the suction cup 22 from a flat surface, the less costly version of the invention shown in FIG. 8 might be preferred. Similarly, where appearance and slight degradation of reflective properties over the long term are not significant considerations, the embodiment of FIG. 8 may be utilized.

In the embodiment of FIG. 8, the preferred sheet material 20'is Reflexite, and is wrapped and adhesively secured to the core member. Although the core could be any shape, the cylindrical shape illustrated is usually desirable in that it has no preferred orientation and is thus most likely to be visible in normal use. Thus, in all the illustrated embodiments, the cylindrical stick in its entirety has a substantially uniform outer diameter.

The reflective stick in accordance with the invention has a variety of uses. It can be used to warn oncoming traffic of a disabled vehicle in the road shoulder. The driver of the disabled vehicle can carry a kit containing the reflective stick as described above, and a rubber suction cup or the like. When the vehicle is stationary, the driver attaches the suction cup to the fender, bumper or window, and hangs the reflective stick therefrom to warn oncoming traffic. If the driver must abandon the vehicle, he can take the device off the vehicle (or preferably have another reflective stick on hand), hold it in the hand nearer the lane of traffic, and walk along the shoulder in search of assistance. The night stick embodiment of the invention provides the walking motorist with an added measure of protection in the vent he or she has an unfriendly encounter while walking.

The device according to the invention is useful as a night communications device, for policemen directing traffic, emergency personnel at accident sites, airline ground crews, and others who must give hand signals at night. Especially for police, the night stick version of the invention provides an attractive, inexpensive piece of combination equipment.

What is claimed is:

1. A reflective stick comprising:

a rigid support cylinder having first and second ends, and defining a stick longitudinal axis;

a sheet member having a reflective outer surface, the sheet member being wrapped around and secured to the support cylinder;

spacer means projecting radially from the support cylinder beyond the radial extent of the sheet member outer surface;

a transparent, tubular sheath coaxially surrounding the support cylinder and having first and second ends extending at least the length of the support cylinder, the sheath being maintained in spaced relation from the sheet member by said spacer means;

a generally tubular handle secured in friction-fit, telescopic relation over the first end of the sheath; and cap means for covering the second end of the sheath.

2. The reflective stock of claim 1, wherein the support cylinder is in the form of a solid rod.

3. The reflective stick of claim 2, wherein the support cylinder is made from one material of the group of materials consisting of metal, wood, and plastic.

4. The reflective stick of claim 1, wherein the support cylinder has an intermediate portion for supporting the sheet member, and radially enlarged end portions, the enlarged portions forming said spacer means.

5. The reflective stick of claim 1, wherein the support cylinder includes an axial channel, and the reflective stick further includes a relatively heavy central rod secured in the channel.

6. The reflective stick of claim 5, wherein the central rod is shorter than the support cylinder channel, and is secured therein by plug members attached to the first and second ends of the support cylinder.

7. The reflective stick of claim 6, wherein the support cylinder has an intermediate portion for supporting the sheet member, and radially enlarged end portions forming said spacer means.

8. The reflective stick of claim 7, wherein the enlarged end portions are integrally formed on the support cylinder.

9. The reflective stick of claim 7, wherein the enlarged end portions are secured in telescoping relation to the first and second ends of the support cylinder.

10. The reflective stick of claim 1, further including a loop member connected to one end of the stick.

11. The reflective stick of claim 10 including, in combination, hook means attachable to a substantially flat surface, for engaging said loop member on the stick and thereby suspending the stick from said flat surface.

12. A reflective night stick comprising:

a hard, rigid support cylinder having first and second ends;

a highly reflective material carried by the outer surface of the support tube;

a transparent, tubular sheath coaxially surrounding and radially spaced from the support cylinder and reflective material, and held in fixed longitudinal relation thereto, the sheath having first and second ends extending at least the length of the support cylinder;

an elongated, thin walled, generally tubular handle secured in friction-fit, telescopic relation over the first end of the sheath; and cap means for closing the second end of the sheath;

wherein the cap means, sheath, and handle form a closed, cylindrical stick having a substantially uniform outer diameter.

13. The reflective stick of claim 12, further including a loop member connected to one end of the stick.

14. The reflective stick of claim 13 including, in combination, hook means attachable to a substantially flat surface, for engaging said loop member on the stick and thereby suspending the stick from said flat surface.

15. A reflective night stick comprising:

a rigid, elongated, core support member having first and second ends, and defining a stick longitudinal axis;

a sheet member having a reflective outer surface, the sheet member being tightly wrapped around and secured to the core member to define a smooth, uncovered reflective surface thereon; and an elongated, substantially cylindrical handle extending longitudinally at one end of the core member;

wherein the handle and the sheet member as secured to the core member have substantially the same outer diameter which defines the exterior surface of the stick.

16. The reflective night stick of claim 15, wherein the core member is cylindrical.

17. The reflective night stick of claim 15, wherein the sheet member is adhesively secured to the core member.

18. The reflective night stick of claim 15, including a cap secured to the other end of the core member.

19. The reflective stick of claim 15, further including a loop member connected to one end of the stick.

20. The reflective stick of claim 19, including, in combination, hook means attachable to a substantially flat surface, for engaging said loop member on the stick and thereby suspending the stick from said flat surface.

* * * * *